US009969960B2

(12) United States Patent
Perez-Garcia et al.

(10) Patent No.: US 9,969,960 B2
(45) Date of Patent: May 15, 2018

(54) AQUEOUS LIQUID COMPOSITION

(71) Applicant: Colgate-Palmolive Company, New York, NY (US)

(72) Inventors: Heriberto Perez-Garcia, Meyehaulco (MX); Arturo Zuniga, Del Alvaro Obregon (MX)

(73) Assignee: Colgate-Palmolive Company, New York, NY (US)

( * ) Notice: Subject to any disclaimer, the term of this patent is extended or adjusted under 35 U.S.C. 154(b) by 20 days.

(21) Appl. No.: 14/915,592

(22) PCT Filed: Aug. 29, 2013

(86) PCT No.: PCT/US2013/057257

§ 371 (c)(1),
(2) Date: Feb. 29, 2016

(87) PCT Pub. No.: WO2015/030768

PCT Pub. Date: Mar. 5, 2015

(65) Prior Publication Data

US 2016/0201014 A1 Jul. 14, 2016

(51) Int. Cl.

| | |
|---|---|
| ***C11D 1/29*** | (2006.01) |
| ***C11D 1/75*** | (2006.01) |
| ***C11D 1/83*** | (2006.01) |
| ***C11D 3/37*** | (2006.01) |
| ***C11D 1/28*** | (2006.01) |
| ***C11D 3/20*** | (2006.01) |

(52) U.S. Cl.

CPC ..... *C11D 3/3707* (2013.01); *C11D 1/28* (2013.01); *C11D 1/75* (2013.01); *C11D 1/83* (2013.01); *C11D 3/201* (2013.01)

(58) Field of Classification Search

CPC .... C11D 1/29; C11D 1/75; C11D 1/83; C11D 3/201; C11D 3/3707

See application file for complete search history.

(56) References Cited

U.S. PATENT DOCUMENTS

| | | | |
|---|---|---|---|
| 4,233,171 | A | 11/1980 | McLaughlin et al. |
| 4,316,824 | A | 2/1982 | Pancheri et al. |
| 4,490,279 | A | 12/1984 | Schmolka |
| 4,608,188 | A | 8/1986 | Parker et al. |

(Continued)

FOREIGN PATENT DOCUMENTS

| | | |
|---|---|---|
| EP | 0222557 | 5/1987 |
| EP | 0621335 | 10/1994 |

OTHER PUBLICATIONS

International Search Report and Written Opinion issued in International Application No. PCT/US2011/057257 dated May 20, 2014.

*Primary Examiner* — Brian P Mruk

(57) ABSTRACT

An aqueous liquid composition, which may be used as a light duty hand dishwashing composition, comprising (i) at least one surfactant, (ii) at least one polyethylene oxide-polypropylene oxide block copolymer which is present in an amount of at least 0.4 weight % based on the weight of the composition, (iii) ethanol which is present in an amount of from 0.5 to 5 weight % based on the weight of the composition, and (iv) water. The mixture of in the polyethylene oxide-polypropylene oxide block copolymer and ethanol can inhibit or prevent gelling of the composition at a temperature below 0 C.

22 Claims, 1 Drawing Sheet

(56) References Cited

U.S. PATENT DOCUMENTS

| | | | | |
|---|---|---|---|---|
| 4,988,452 | A | 1/1991 | Kinstedt et al. | |
| 5,516,452 | A | 5/1996 | Welch et al. | |
| 5,518,648 | A | 5/1996 | Welch et al. | |
| 2003/0158078 | A1 | 8/2003 | Chang | |
| 2005/0272619 | A1 | 12/2005 | Borgonjon et al. | |
| 2006/0019851 | A1 | 1/2006 | Hecht et al. | |
| 2006/0105931 | A1 | 5/2006 | Shi et al. | |
| 2006/0281663 | A1 | 12/2006 | Asmus | |
| 2009/0105113 | A1* | 4/2009 | Tuzi | C11D 1/37<br>510/418 |
| 2013/0267451 | A1 | 10/2013 | Hardy | |

* cited by examiner

AQUEOUS LIQUID COMPOSITION

BACKGROUND

Aqueous liquid compositions, for example hand dishwashing compositions, generally need to have a specified viscosity behavior to be acceptable to the consumer. Many liquid compositions should have a viscosity behavior which provides pourability and ease of dissolution in water in order to be considered consumer acceptable, particularly in liquid cleaning products like hand dishwashing liquid. For hand dishwashing compositions the dissolution rate of the liquid in water is desired to be rapid so that foam generation is not delayed, since foam is a signal to consumers that the detergent is high quality. Pourability and dissolution are in part linked to liquid viscosity.

A variety of different viscosity control agents are conventionally used in such compositions.

Ethanol is known for uses as a viscosity controller in aqueous hand dishwashing liquid compositions, even though the ethanol does not contribute to enhanced dishwashing performance. However, in order to provide the required viscosity control, ethanol tends to be used at high concentrations. For example ethanol comprises 6.5 weight % of the total composition in one known aqueous hand dishwashing liquid composition. Such high ethanol compositions may have the desired viscosity profile, but may form an undesired gel phase at temperatures below 0° C., for example at a temperature of −4° C. or lower, causing an evident phase separation at the bottom of a bottle containing the composition. This is undesirable for the consumer. Also, the high ethanol content increases the cost of the composition. For example, a 6.5 weight % ethanol content may represent about 12% of the cost of the aqueous hand dishwashing liquid composition.

There is a need in the art for aqueous liquid compositions, for example hand dishwashing compositions, which can incorporate a viscosity modifier system to provide a viscosity behavior which is acceptable to the consumer yet avoids the gel phase formation and high ethanol cost of known ethanol-containing formulations.

Therefore, it would be desirable to provide an aqueous liquid composition, for example a hand dishwashing composition, which can provide the combination of a desired viscosity behavior, good anti-gelling performance at subzero temperatures and an acceptable production cost.

BRIEF SUMMARY

An aqueous liquid composition comprising (i) at least one surfactant, (ii) at least one polyethylene oxide-polypropylene oxide block copolymer which is present in an amount of at least 0.4 weight % based on the weight of the composition, (iii) ethanol which is present in an amount of from 0.5 to 5 weight % based on the weight of the composition, and (iv) water.

A light duty hand dishwashing aqueous liquid composition comprising (i) at least one anionic alkyl ether sulfate surfactant selected from ammonium lauryl ether sulfate and an alkali metal lauryl ether sulfate or a mixture thereof, the at least one alkyl ether sulfate having an ethoxylation (EO) of from 0.5 to 2, wherein the at least one anionic alkyl ether sulfate surfactant is present in an amount of from 10 to 25 weight % based on the weight of the composition, (ii) at least one amine oxide surfactant selected from lauryl amidopropyl dimethyl amine oxide and myristyl amidopropyl dimethyl amine oxide or a mixture thereof, wherein the at least one amine oxide surfactant is present in an amount of from 3 to 8 weight % based on the weight of the composition, (iii) at least one polyethylene oxide-polypropylene oxide block copolymer which is present in an amount of from 1 to 2 weight % based on the weight of the composition, wherein the polyethylene oxide-polypropylene oxide block copolymer has the formula (EO)x(PO)y(EO)z where EO is ethylene oxide, PO is propylene oxide, x=11+/−3, y=21+/−5 and z=11+/−3, (iv) ethanol which is present in an amount of from 1 to 2 weight % based on the weight of the composition, and (v) water.

Use, in an aqueous liquid composition comprising at least one surfactant and water, of a mixture of (a) at least one polyethylene oxide-polypropylene oxide block copolymer which is present in an amount of from 0.4 to 5 weight % based on the weight of the composition and (b) ethanol which is present in an amount of from 0.5 to 5 weight % based on the weight of the composition, for inhibiting or preventing gelling of the composition at a temperature below 0° C.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
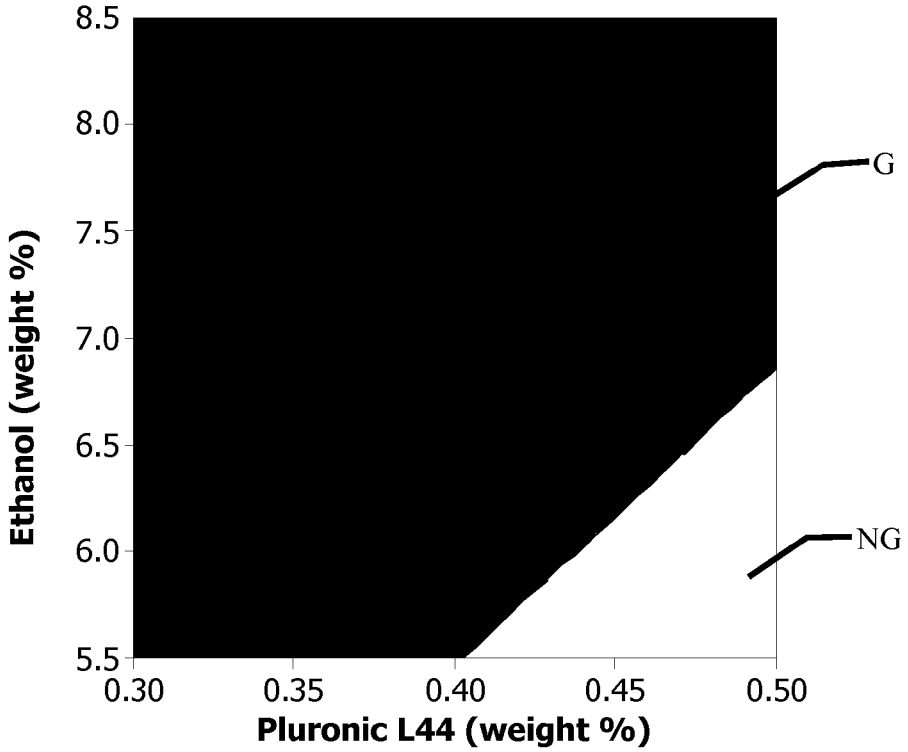
FIG. 1 is a graph of showing the tendency for the formation of gel at a temperature of −4° C. for a first group of hand dishwashing aqueous liquid compositions incorporating varied amounts of a polyethylene oxide-polypropylene oxide block copolymer and ethanol. Area marked with G is gelled. Area marked with NG is not gelled.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

In a particular embodiment, there is provided an aqueous liquid composition comprising (i) at least one surfactant, (ii) at least one polyethylene oxide-polypropylene oxide block copolymer which is present in an amount of at least 0.4 weight % based on the weight of the composition, (iii) ethanol which is present in an amount of from 0.5 to 5 weight % based on the weight of the composition, and (iv) water.

The aqueous liquid composition can be formulated to be any type of surfactant-containing detergent composition. The composition can be used as a light duty liquid (LDL) dishwashing detergent, hand liquid soap, body wash, or a liquid laundry detergent. One embodiment described below will be for a hand dishwashing detergent. In preferred embodiments, the composition is a light duty hand dishwashing composition.

In preferred embodiments, there is provided a light duty hand dishwashing aqueous liquid composition comprising (i) at least one anionic alkyl ether sulfate surfactant selected from ammonium lauryl ether sulfate and an alkali metal lauryl ether sulfate or a mixture thereof, the at least one alkyl ether sulfate having an ethoxylation (EO) of from 0.5 to 2, wherein the at least one anionic alkyl ether sulfate surfactant is present in an amount of from 10 to 25 weight % based on the weight of the composition, (ii) at least one amine oxide surfactant selected from lauryl amidopropyl dimethyl amine oxide and myristyl amidopropyl dimethyl amine oxide or a mixture thereof, wherein the at least one amine oxide surfactant is present in an amount of from 3 to 8 weight % based on the weight of the composition, (iii) at least one polyethylene oxide-polypropylene oxide block copolymer which is present in an amount of from 1 to 2 weight % based on the weight of the composition, wherein the polyethylene oxide-polypropylene oxide block copolymer has the formula (EO)x(PO)y(EO)z where EO is ethylene oxide, PO is propylene oxide, x=11+/−3, y=21+/−5 and z=11+/−3, (iv) ethanol which is present in an amount of from 1 to 2 weight % based on the weight of the composition, and (v) water.

There is also provided, in some embodiments, the use, in an aqueous liquid composition comprising at least one surfactant and water, of a mixture of (a) at least one polyethylene oxide-polypropylene oxide block copolymer which is present in an amount of from 0.4 to 5 weight % based on the weight of the composition and (b) ethanol which is present in an amount of from 0.5 to 5 weight % based on the weight of the composition, for inhibiting or preventing gelling of the composition at a temperature below 0° C.

Optionally, the polyethylene oxide-polypropylene oxide block copolymer has the formula (EO)x(PO)y(EO)z where EO is ethylene oxide, PO is propylene oxide, x=11+/−3, y=21+/−5 and z=11+/−3.

Optionally, the at least one surfactant comprises a mixture of (i) at least one anionic surfactant selected from ammonium lauryl ether sulfate and an alkali metal lauryl ether sulfate or a mixture thereof, the at least one alkyl ether sulfate having an ethoxylation (EO) of from 0.5 to 2, wherein the at least one at least one $C_8$-$C_{18}$ alkyl ether sulfate surfactant is present in an amount of from 10 to 25 weight % based on the weight of the composition, and (ii) at least one amine oxide surfactant selected from lauryl amidopropyl dimethyl amine oxide and myristyl amidopropyl dimethyl amine oxide or a mixture thereof, wherein the at least one amine oxide surfactant is present in an amount of from 3 to 8 weight % based on the weight of the composition.

The liquid composition accordingly comprises at least one surfactant, the at least one surfactant providing the desired cleaning properties of the composition, together with at least one polyethylene oxide-polypropylene oxide block copolymer and ethanol which both modify the viscosity and phase stability of the liquid composition. In particular, a desirable pourable viscosity is provided, together with a robustness against gel formation at low temperatures, in particular sub-zero (° C.) temperatures, such as −4° C.

Without being bound by any theory, it has been found that aqueous liquid surfactant-containing compositions can employ an ethanol content combined with a polyethylene oxide-polypropylene oxide block copolymer content to provide a robust phase stability at sub-zero temperatures while providing the desired viscosity profile of the composition.

By reducing the ethanol concentration as compared to some known compositions, a material cost reduction can be achieved. To regulate the viscosity as a result of the reduced ethanol content, a concentration of the polyethylene oxide-polypropylene oxide block copolymer can be provided. Any increase in concentration of the polyethylene oxide-polypropylene oxide block copolymer is less than the decrease in the amount of ethanol while maintaining the desired viscosity profile, since the polyethylene oxide-polypropylene oxide block copolymer has a greater effect on viscosity, per unit of concentration, as compared to the ethanol. Therefore there is a net cost saving by employing the increased concentration of the polyethylene oxide-polypropylene oxide block copolymer to offset the reduced concentration of ethanol.

Furthermore, without being bound by any theory, the combination of the increased concentration of the polyethylene oxide-polypropylene oxide block copolymer and the reduced concentration of ethanol was found unexpectedly to enhance the robustness against gel formation at sub-zero temperatures, while maintaining the desired viscosity profile of the composition.

In particular, by providing, in such a surfactant-containing aqueous liquid composition, the combination of at least one polyethylene oxide-polypropylene oxide block copolymer which is present in an amount of at least 0.4 weight % based on the weight of the composition, and ethanol which is present in an amount of from 0.5 to 5 weight % based on the weight of the composition, the gelling of the composition at a temperature below 0° C. may be inhibited or prevented.

This technical effect can be achieved without increasing the cost of the composition, or significantly changing the viscosity profile, as compared to known compositions.

Surfactants

The aqueous liquid composition comprises at least one surfactant which provides cleaning, and optionally foaming, properties to the composition. The surfactant can be any surfactant or any combination of surfactants. Examples of surfactants include anionic, nonionic, cationic, amphoteric, or zwitterionic.

In preferred embodiments, the at least one surfactant is present in an amount of from 15 to 30 weight % based on the weight of the composition. A typical surfactant content is from 20 to 25 weight % on an surfactant active ingredient (AI) basis.

In preferred embodiments, the at least one surfactant comprises a mixture of (a) at least one anionic surfactant and (b) at least one amine oxide surfactant.

Anionic surfactants include, but are not limited to, those surface-active or detergent compounds that contain an organic hydrophobic group containing generally 8 to 26 carbon atoms, such as generally 8 to 18 carbon atoms, in their molecular structure and at least one water-solubilizing group selected from sulfonate, sulfate, and carboxylate so as to form a water-soluble detergent. Usually, the hydrophobic group will comprise a $C_8$-$C_{22}$ alkyl, or acyl group. Such surfactants are employed in the form of water-soluble salts and the salt-forming cation usually is selected from sodium, potassium, ammonium, magnesium and mono-, di- or tri-$C_2$-$C_3$ alkanolammonium, with the sodium, magnesium and ammonium cations again being the usual ones chosen.

In preferred embodiments, the at least one anionic surfactant comprises at least one $C_8$-$C_{18}$ alkyl ether sulfate surfactant having an ethoxylation (EO) of from 0.5 to 10, optionally from 0.5 to 2, typically about 0.6.

In preferred embodiments, the at least one $C_8$-$C_{18}$ alkyl ether sulfate surfactant is selected from at least one of ammonium lauryl ether sulfate and an alkali metal lauryl ether sulfate. The at least one $C_8$-$C_{18}$ alkyl ether sulfate surfactant may be typically present in an amount of from 10 to 25 weight % based on the weight of the composition.

The anionic surfactants that are used in the composition of this invention are water soluble and include, but are not limited to, the sodium, potassium, ammonium, and ethanolammonium salts of linear $C_8$-$C_{16}$ alkyl benzene sulfonates, alkyl ether carboxylates, $C_{10}$-$C_{20}$ paraffin sulfonates, $C_8$-$C_{25}$ alpha olefin sulfonates, $C_8$-$C_{18}$ alkyl sulfates, $C_8$-$C_{18}$ alkyl ether sulfates and mixtures thereof.

Pareth sulfate surfactants can also be included in the composition. The pareth sulfate surfactant is a salt of an ethoxylated $C_{10}$-$C_{16}$ pareth sulfate surfactant having 1 to 30 moles of ethylene oxide. In some embodiments, the amount of ethylene oxide is 1 to 6 moles, and in other embodiments it is 2 to 3 moles, and in another embodiment it is 2 moles. In one embodiment, the pareth sulfate is a $C_{12}$-$C_{13}$ pareth sulfate with 2 moles of ethylene oxide. Naturally derived alkyl chains can also be used, such as laureth sulfate, as well as non ethoxylated alcohol sulfates like lauryl sulfate.

Examples of suitable other sulfonated anionic detergents are the well-known higher alkyl mononuclear aromatic sulfonates, such as the higher alkylbenzene sulfonates containing 9 to 18 or preferably 9 to 16 carbon atoms in the higher alkyl group in a straight or branched chain, or $C_8$-$C_{15}$ alkyl toluene sulfonates.

Other suitable anionic surfactants are the olefin sulfonates, including long-chain alkene sulfonates, long-chain hydroxyalkane sulfonates or mixtures of alkene sulfonates and hydroxyalkane sulfonates.

Examples of satisfactory anionic sulfate surfactants are the alkyl sulfate salts and the alkyl ether polyethenoxy sulfate salts having the formula $R(OC_2H_4)_n$ $OSO_3M$ wherein n is 0.5 to 10, and R is an alkyl group having about 8 to about 18 carbon atoms and M is a solubilizing cation selected from sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product.

The ethoxylated alkyl ether sulfate may be made by sulfating the condensation product of ethylene oxide and $C_8$-$C_{18}$ alkanol, and neutralizing the resultant product. The ethoxylated alkyl ether sulfates differ from one another in the number of carbon atoms in the alcohols and in the number of moles of ethylene oxide reacted with one mole of such alcohol.

Ethoxylated $C_8$-$C_{18}$ alkylphenyl ether sulfates containing from 2 to 6 moles of ethylene oxide in the molecule are also suitable for use in the composition of some embodiments. These detergents can be prepared by reacting an alkyl phenol with 2 to 6 moles of ethylene oxide and sulfating and neutralizing the resultant ethoxylated alkylphenol.

Other suitable anionic detergents are the $C_9$-$C_{15}$ alkyl ether polyethenoxyl carboxylates having the structural formula $R(OC_2H_4)_nOX$ COOH wherein n is a number from 4 to 12, or 6 to 11 and X is selected from the group consisting of $CH_2$, $C(O)R_1$ and

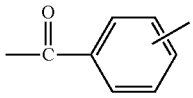

wherein $R_1$ is a $C_1$-$C_3$ alkylene group. Types of these compounds include, but are not limited to, $C_9$-$C_{11}$ alkyl ether polyethenoxy (7-9) C(O) $CH_2CH_2COOH$, $C_{13}$-$C_{15}$ alkyl ether polyethenoxy (7-9)

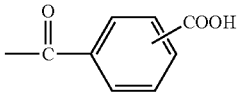

and $C_{10}$-$C_{12}$ alkyl ether polyethenoxy (5-7) $CH_2COOH$. These compounds may be prepared by condensing ethylene oxide with appropriate alkanol and reacting this reaction product with chloracetic acid to make the ether carboxylic acids or with succinic anhydride or phthalic anhydride.

The amine oxide may be depicted by the formula:

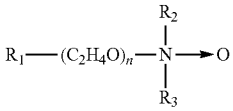

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms; $R_2$ and $R_3$ are each methyl, ethyl, propyl, isopropyl, 2-hydroxyethyl, 2-hydroxypropyl, or 3-hydroxypropyl; and n is from 0 to about 10. In one embodiment, the amine oxides are of the formula:

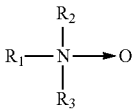

wherein $R_1$ is a $C_{12}$-$C_{18}$ alkyl and $R_2$ and $R_3$ are methyl or ethyl. The above ethylene oxide condensates, amides, and amine oxides are more fully described in U.S. Pat. No. 4,316,824. In another embodiment, the amine oxide is depicted by the formula:

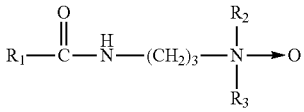

wherein $R_1$ is a saturated or unsaturated alkyl group having 6 to 24 carbon atoms, $R_2$ is a methyl group, and $R_3$ is a methyl or ethyl group.

In preferred embodiments, the at least one amine oxide surfactant comprises at least one $C_8$-$C_{18}$ alkyl amidoalkyl-substituted amine oxide, and optionally may be selected from at least one of lauryl amidopropyl dimethyl amine oxide and myristyl amidopropyl dimethyl amine oxide or a mixture thereof. Typically, the at least one $C_8$-$C_{18}$ alkyl amidoalkyl-substituted amine oxide surfactant is a mixture of lauryl amidopropyl dimethyl amine oxide and myristyl amidopropyl dimethyl amine oxide. The at least one $C_8$-$C_{18}$ alkyl amidoalkyl-substituted amine oxide surfactant may be typically present in an amount of from 1 to 10 weight %, optionally from 3 to 8 weight %, based on the weight of the composition.

In preferred embodiments, the weight ratio of the at least one anionic surfactant and the at least one amine oxide surfactant is from 3:1 to 5:1.

The composition may additionally contain water soluble nonionic surfactants, such as those which are commercially well known and include the primary aliphatic alcohol ethoxylates, secondary aliphatic alcohol ethoxylates, alkylphenol ethoxylates and ethylene-oxide-propylene oxide condensates on primary alkanols, such as PLURAFAC™ surfactants (BASF) and condensates of ethylene oxide with sorbitan fatty acid esters such as the TWEEN™ surfactants (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water-soluble nonionic detergent. Further, the length of the polyethenoxy chain can be adjusted to achieve the desired balance between the hydrophobic and hydrophilic elements. Other nonionic surfactants may be present in the composition.

The composition may additionally contain water soluble zwitterionic surfactant which can be selected from any known zwitterionic surfactant. In one embodiment, the zwitterionic surfactant is a water soluble betaine having the general formula

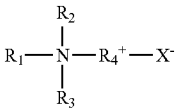

wherein $X^-$ is selected from $COO^-$ and $SO_3^-$ and $R_1$ is an alkyl group having 10 to about 20 carbon atoms, or 12 to 16 carbon atoms, or the amido radical:

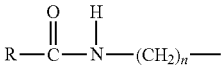

wherein R is an alkyl group having about 9 to 19 carbon atoms and n is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group.

Viscosity Control Agents

The aqueous liquid composition comprises (i) at least one polyethylene oxide-polypropylene oxide block copolymer and (ii) ethanol which both control the viscosity of the composition. Such viscosity control agents are included to modify the composition to obtain a desired viscosity of the composition at rest and to allow a desired flow and dissolution of the composition when dispensed from a container and used.

In preferred embodiments, the at least one polyethylene oxide-polypropylene oxide block copolymer is present in an amount of from 0.4 to 5 weight %, optionally from 1 to 2 weight %, typically about 1.5 weight %, based on the weight of the composition.

In preferred embodiments, the polyethylene oxide-polypropylene oxide block copolymer has the formula (EO)x (PO)y(EO)z where EO is ethylene oxide, PO is propylene oxide, x=11+/−3, y=21+/−5 and z=11+/−3.

In preferred embodiments, the ethanol is present in an amount of from 1 to 2 weight %, optionally from 1.25 to 1.75 weight %, typically about 1.5 weight %, based on the weight of the composition.

The composition may optionally comprise one or more additional viscosity control agents. Such agents include, but are not limited to, an ionic additive, polypropylene glycol, polysorbate 20 (TWEEN™20), POLOXAMER™ L35, POLOXAMER™ L31, polyethylene glycol 55 (PEG-55), glycerin, diethylene glycol, CREMOPHOR™ polyoxyethyleneglyceroltriricinoleat, GLUCAM™ P-10 propylene glycol ether of methyl glucose with 10 polypropylene oxide units, PLURIOL™ E300 alkoxylates based on ethylene oxide and propylene oxide, sodium cumene sulfonate (SCS), sodium xylene sulfonate (SXS), GLUCAM™ P-20 propylene glycol ether of methyl glucose with 20 polypropylene oxide units, GLUCAM™ E-20 ethylene glycol ether of methyl glucose with 20 polyethylene oxide units, GLUCAM™ E-10 ethylene glycol ether of methyl glucose with 10 polyethylene oxide units, and short chain ethoxylated propoxylated alcohols such as PPG2-Buteth-3, PPG3-Buteth-5, or PPG5-Buteth-7.

The ionic additive may be a salt, which can include any desirable salt. Examples of salts include, but are not limited to, sodium chloride and magnesium sulfate.

Liquid Viscosity

In preferred embodiments, the composition has a viscosity of from 800 to 1500 Centipoise as measured on a Brookfield RVT Viscometer using spindle 21 at 20 RPM at 25° C.

The composition has a viscosity that allows the composition to be pourable.

In certain embodiments, such as when the composition is used as a hand dishwashing liquid, the composition can be dispersed in water in less than about 5 minutes. In other embodiments, the time is less than about 4 minutes, less than about 3 minutes, less than about 2.5 minutes, less than about 2 minutes, or less than 1 minute.

Additional Components

The composition may also contain additional components.

The composition may also contain solvents or salts to modify the cleaning, stability and rheological properties of the composition.

Solvents can include any water soluble solvents. Water soluble solvents, in addition to ethanol, include, but are not limited to, $C_{2-4}$ mono, dihydroxy, or polyhydroxy alkanols and/or an ether or diether, such as isopropanol, diethylene glycol monobutyl ether, dipropylene glycol methyl ether, diproyleneglycol monobutyl ether, propylene glycol n-butyl ether, propylene glycol, and hexylene glycol, urea, and alkali metal cumene, alkali metal toluene, or alkali metal xylene sulfonates such as sodium cumene sulfonate and sodium xylene sulfonate.

Additional optional ingredients may be included to provide added effect or to make the product more attractive. Such ingredients include, but are not limited to, perfumes, fragrances, colorants, pigments, dyes, abrasive agents, disinfectants, radical scavengers, bleaches, chelating agents, antibacterial agents/preservatives, optical brighteners, hydrotropes, or combinations thereof.

Generally, water is included in the composition. The amount of water is variable depending on the amounts of other materials added to the composition.

The compositions can be made by simple mixing methods from readily available components which, on storage, do not adversely affect the entire composition. Mixing can be done by any mixer that forms the composition. Examples of mixers include, but are not limited to, static mixers and in-line mixers. Solubilizing agents such as a $C_1$-$C_3$ alkyl substituted benzene sulfonate such as sodium cumene or sodium xylene sulfonate and mixtures thereof can be used at a concentration of 0.05 weight % to 10 weight % to assist in solubilizing the surfactants.

The composition can be provided in any type and shape of container that is compatible with the composition. Non-limiting examples of containers are made from plastic or glass. For consumer convenience, plastic may be chosen. The plastic can be any type of plastic. Examples of plastic include, but are not limited to, polyethylene tetra phthalate (PET), polyethylene, polypropylene, or polyvinyl chloride. Container properties, such as clarity, gloss, color, and shape can be selected to provide a desired aesthetic effect.

Suspended Material

In some embodiments, the liquid composition may suspend a solid suspended material, and may accordingly include one or more suspending agents. It is known in the art to suspend materials, for example in particulate form, in liquid compositions such as light duty hand dishwashing aqueous liquid composition. The combination of the liquid and the suspended material in the entire composition provides a desired aesthetic appearance. The composition may therefore be formulated to provide not only the desired pourable viscosity but also the ability to suspend materials.

The suspended material can be density matched to the liquid portion if very low viscosity is desired. Density matched means that the density of the suspended material is close to the density of the liquid portion so that the suspended material remains suspended. For example, the density of the suspended material may be a density that is 97% to 103% of the density value of the liquid portion. Alternatively, the suspended material can be non-density matched to the liquid portion.

The selection of the suspending agent is affected by the ionic strength of the composition. As the amount of ionic material increases (such as anionic surfactants), more suspending agent is generally needed. In certain embodiments, a polymeric suspending agent can be selected to have a level of crosslinking to give a desired viscosity, pourability, and dispersability to the composition.

Suspending agents are any material that increases the ability of the composition to suspend material. Examples of suspending agents include, but are not limited to, synthetic suspending agents, gellan gum, polymeric gums, polysaccharides, pectine, alginate, arabinogalactan, carageenan, xanthum gum, guar gum, rhamsan gum, furcellaran gum, and other natural gum. A synthetic suspending agent in one embodiment is an acrylic polymer, such as a polyacrylate.

EXAMPLES

The following examples illustrate compositions of the invention. Unless otherwise specified, all percentages are by weight. The abbreviation AI refers to the total active ingredient amount of surfactant(s). The exemplified compositions are illustrative only and do no limit the scope of the invention.

Comparative Example 1

A known light duty hand dishwashing composition is shown in Table 1. This composition comprised anionic surfactant (an alkyl ethoxylated sulfate AEOS, in particular Na lauryl ether (0.6 EO) sulfate), amine oxide surfactant (in particular lauryl myristyl dimethyl amine oxide), magnesium sulfate and fragrance. In this known composition, ethanol was also present as a viscosity modifier.

TABLE 1

| | Comparative Example 1 - weight % (22.5% AI) |
|---|---|
| Na lauryl ether (0.6 EO) sulfate | 17.6 |
| Lauryl myristyl dimethyl amine oxide | 4.9 |
| $MgSO_4$ | 2 |
| Ethanol | 6.9 |
| Fragrance | 0.4 |
| Water | QS |

Pluronic L44 polymer is a polyethylene oxide-polypropylene oxide block copolymer which has the formula (EO)x(PO)y(EO)z where EO is ethylene oxide, PO is propylene oxide, x=11+/−3, y=21+/−5 and z=11+/−3. An amount of the polyethylene oxide-polypropylene oxide block copolymer was added to the composition of Table 1 to determine the viscosity and low temperature gelling properties.

The amount of Pluronic L44 polymer was 0.3 weight % based on the total weight of the composition and the amount of ethanol was 6.9 weight % based on the total weight of the composition.

The phase stability of this composition was tested at a temperature of −4° C.

It was found that a solid gel was formed at this temperature. The composition has poor phase stability at sub-zero temperatures.

Comparative Example 2

The composition of Comparative Example 1 was modified by varying the concentrations of Pluronic L44 polymer and ethanol in the composition of Table 1 and testing the phase stability at a temperature of −4° C. The amount of Pluronic L44 polymer varied between 0.3 and 0.5 weight % based on the total weight of the composition and the amount of ethanol varied between 5.5 and 8.5 weight % based on the total weight of the composition.

The results are shown in FIG. 1. This is a contour plot showing the incidence of gelling at a temperature of −4° C. for varying concentrations of the Pluronic L44 polymer and ethanol with the base composition of anionic surfactant (an alkyl ethoxylated sulfate AEOS, in particular Na lauryl ether (0.6 EO) sulfate), amine oxide surfactant (in particular lauryl myristyl dimethyl amine oxide), magnesium sulfate and fragrance shown in Table 1.

The dark area in FIG. 1 indicates compositions which resulted in gel formation at a temperature of −4° C. The light area in FIG. 1 conversely indicates compositions which resulted in an absence of gel formation at a temperature of −4° C.

It may be seen from FIG. 1 that generally higher amounts of Pluronic L44 polymer and generally lower amounts of ethanol tended to reduce the incidence of gel formation at a temperature of −4° C. In particular, at a minimum ethanol concentration of 5.5 weight %, the minimum concentration of Pluronic L44 polymer to avoid gelling was found to be 0.4 weight %.

Example 1

The compositions of Comparative Examples 1 and 2 have a high ethanol content, which increases the production cost of the light duty hand dishwashing compositions.

In contrast, in Example 1 light duty hand dishwashing compositions comprising lower concentrations of ethanol and higher concentrations of the Pluronic L44 polymer were tested to determine the gelling behavior of the resultant compositions at a temperature of −4° C.

The use of a lower ethanol content reduces production costs.

The use of higher concentrations of the Pluronic L44 polymer provides a more stable viscosity profile at higher shear rates, which is desirable for exhibiting stable viscosity during dispensing of the liquid composition by pouring from a container. The Pluronic L44 polymer was found to provide a large impact on the viscosity of the composition, with viscosity generally decreasing with higher amounts of the Pluronic L44 polymer, and so increasing the concentration of the Pluronic L44 polymer can provide a stable viscosity profile without an excessive increase in the composition viscosity.

The base composition of Example 1 is shown in Table 2.

This composition comprised anionic surfactant (AEOS), amine oxide surfactant, sodium chloride and fragrance. Again, this composition additionally comprised varying amounts of Pluronic L44 polymer and ethanol. The amount of Pluronic L44 polymer was varied from about 1.35 to about 1.65 weight % based on the total weight of the composition and the amount of ethanol was varied from about 1.3 to about 1.7 weight % based on the total weight of the composition.

TABLE 2

| | Example 1 - weight % (22.25% AI) |
|---|---|
| Na lauryl ether (0.6 EO) sulfate | 17.38 |
| Lauryl myristyl dimethyl amine oxide | 4.87 |
| NaCl | 1.5 |
| Pluronic L44 polymer | Varying (about 1.35 to about 1.65 weight %) |
| Ethanol | Varying (about 1.3 to about 1.7 weight %) |
| Fragrance | 0.41 |
| Water | QS |

The phase stability of this composition was tested at a temperature of −4° C.

Figure 2:
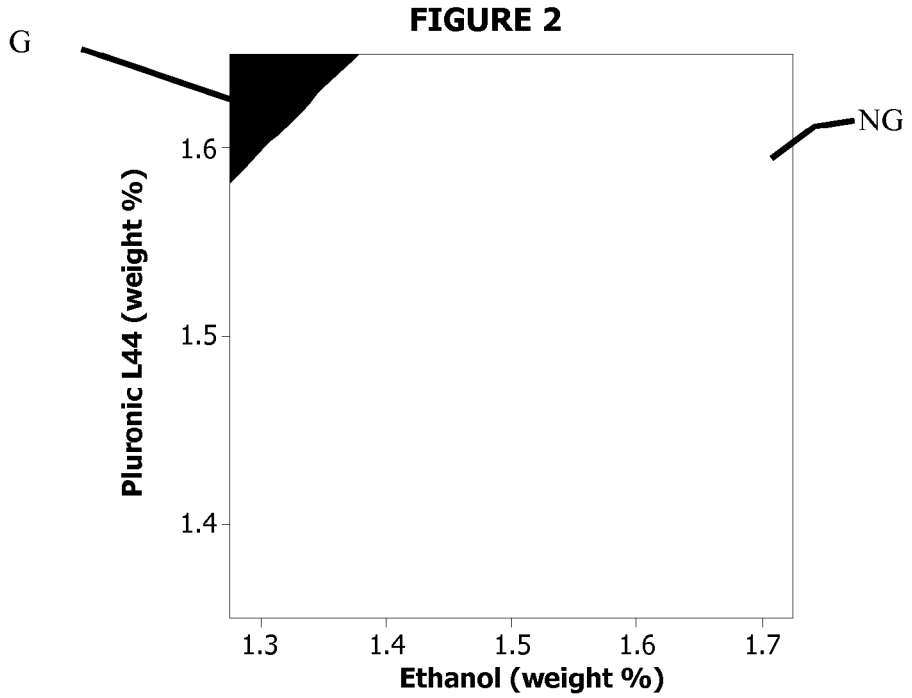
FIG. 2 is a graph of showing the tendency for the formation of gel at a temperature of −4° C. for a second group of hand dishwashing aqueous liquid compositions incorporating varied amounts of a polyethylene oxide-polypropylene oxide block copolymer and ethanol. Area marked with G is gelled. Area marked with NG is not gelled.

The results are shown in FIG. 2. This is a contour plot showing the incidence of gelling at a temperature of −4° C. for varying concentrations of the Pluronic L44 polymer and ethanol with the base composition in Table 2.

The dark area in FIG. 2 indicates compositions which resulted in gel formation at a temperature of −4° C. The light area in FIG. 2 conversely indicates compositions which resulted in an absence of gel formation at a temperature of −4° C.

It may be seen that for a wide range of amounts of Pluronic L44 polymer, up to about 1.65 weight % and for a wide range of amounts of ethanol, there was an absence of gel formation at a temperature of −4° C.

It was found that no solid gel was formed at this temperature when the concentration of the Pluronic L44 polymer was up to about 1.65 weight % with an ethanol concentration of at least about 1.4 weight %. For example, with a 1.5 weight % concentration of the Pluronic L44 polymer and a 1.5 weight % ethanol concentration, gelling was avoided at a temperature of −4° C.

Consequently it was found that as compared to known compositions, lower ethanol content combined with a polyethylene oxide-polypropylene oxide block copolymer content can provide a robust phase stability at sub-zero temperatures while providing the desired viscosity profile of the composition.

By reducing the ethanol concentration as compared to Example 1, significant material cost reductions can be achieved. To regulate the viscosity as a result of the reduced ethanol content, the concentration of the polyethylene oxide-polypropylene oxide block copolymer is increased. However, the increase in concentration of the polyethylene oxide-polypropylene oxide block copolymer is less than the decrease in the amount of ethanol while maintaining the desired viscosity profile, since the polyethylene oxide-polypropylene oxide block copolymer has a greater effect on viscosity, per unit of concentration, as compared to the ethanol. Therefore there is a net cost saving by employing the increased concentration of the polyethylene oxide-polypropylene oxide block copolymer to offset the reduced concentration of ethanol.

Furthermore, the combination of the increased concentration of the polyethylene oxide-polypropylene oxide block copolymer and the reduced concentration of ethanol was found unexpectedly to enhance the robustness against gel formation at sub-zero temperatures, while maintaining the desired viscosity profile of the composition.

In particular, by providing in such a surfactant-containing aqueous liquid composition the combination of at least one polyethylene oxide-polypropylene oxide block copolymer which is present in an amount of at least 0.4 weight % based on the weight of the composition, and ethanol which is present in an amount of from 0.5 to 5 weight % based on the weight of the composition, the gelling of the composition at a temperature below 0° C. may be inhibited or prevented. This technical effect can be achieved without increasing the cost of the composition, or significantly changing the viscosity profile, as compared to known compositions. The concentration of the polyethylene oxide-polypropylene oxide block copolymer (e.g. in the Pluronic L44 polymer) may typically be up to 5 weight %, and typically lower than 5 weight % to reduce production costs.

What is claimed is:

1. An aqueous liquid composition comprising:

(i) at least one surfactant, (ii) from about 1 to about 2 weight % of a polyethylene oxide-polypropylene oxide block copolymer, based on the weight of the composition, (iii) from about 1 to about 2 weight % of ethanol based on the weight of the composition, and (iv) water.

2. The composition of claim 1 wherein the polyethylene oxide-polypropylene oxide block copolymer and the ethanol are present in a weight ratio of about 1:1.

3. The composition of claim 2 wherein the polyethylene oxide-polypropylene oxide block copolymer is present in an amount of from about 1.3 to about 1.7 weight % based on the weight of the composition.

4. The composition of claim 3 wherein the at least one polyethylene oxide-polypropylene oxide block copolymer is present in an amount of about 1.5 weight % based on the weight of the composition.

5. The composition of claim 1 wherein the polyethylene oxide-polypropylene oxide block copolymer has the formula $(EO)_x(PO)_y(EO)_z$ where EO is ethylene oxide, PO is propylene oxide, x=11+/−3, y=21+/−5 and z=11+/−3.

6. The composition of claim 1 wherein the ethanol is present in an amount of from 1.25 to 1.75 weight % based on the weight of the composition.

7. The composition of claim 1 wherein the at least one surfactant is present in an amount of from 15 to 30 weight % based on the weight of the composition.

8. The composition of claim 1 wherein the at least one surfactant comprises a mixture of (a) at least one anionic surfactant and (b) at least one amine oxide surfactant.

9. The composition of claim 8 wherein the at least one anionic surfactant comprises at least one $C_{8-18}$ alkyl ether sulfate surfactant having an ethoxylation (EO) of from 0.5 to 10.

10. The composition of claim 9 wherein the at least one $C_{8-18}$ alkyl ether sulfate surfactant has an ethoxylation (EO) of from 0.5 to 2.

11. The composition of claim 10 wherein the at least one $C_{8-18}$ alkyl ether sulfate surfactant has an ethoxylation (EO) of about 0.6.

12. The composition of claim 9 wherein the at least one $C_{8-18}$ alkyl ether sulfate surfactant is selected from at least one of ammonium lauryl ether sulfate and an alkali metal lauryl ether sulfate.

13. The composition of claim 9 wherein the at least one $C_{8-18}$ alkyl ether sulfate surfactant is present in an amount of from 10 to 25 weight % based on the weight of the composition.

14. The composition of claim 8 wherein the at least one amine oxide surfactant comprises at least one $C_{8-18}$ alkyl amidoalkyl-substituted amine oxide.

15. The composition of claim 14 wherein the at least one $C_{8-18}$ alkyl amidoalkyl-substituted amine oxide surfactant is selected from at least one of lauryl amidopropyl dimethyl amine oxide and myristyl amidopropyl dimethyl amine oxide or a mixture thereof.

16. The composition of claim 15 wherein the at least one $C_{8-18}$ alkyl amidoalkyl-substituted amine oxide surfactant is a mixture of lauryl amidopropyl dimethyl amine oxide and myristyl amidopropyl dimethyl amine oxide.

17. The composition of claim 14 wherein the at least one $C_{8-18}$ alkyl amidoalkyl-substituted amine oxide surfactant is present in an amount of from 1 to 10 weight % based on the weight of the composition.

18. The composition of claim 17 wherein the at least one $C_{8-18}$ alkyl amidoalkyl-substituted amine oxide surfactant is present in an amount of from 3 to 8 weight % based on the weight of the composition.

19. The composition of claim 8 wherein the weight ratio of the at least one anionic surfactant and the at least one amine oxide surfactant is from 3:1 to 5:1.

20. The composition of claim 1 wherein the composition has a viscosity of from 800 to 1500 Centipoise as measured on a Brookfield RVT Viscometer using spindle 21 at 20 RPM at 25° C.

21. The composition of claim 1 which is a light duty hand dishwashing composition.

22. A light duty hand dishwashing aqueous liquid composition comprising (i) at least one anionic alkyl ether sulfate surfactant selected from ammonium lauryl ether sulfate and an alkali metal lauryl ether sulfate or a mixture thereof, the at least one alkyl ether sulfate having an ethoxylation (EO) of from 0.5 to 2, wherein the at least one anionic alkyl ether sulfate surfactant is present in an amount of from 10 to 25 weight % based on the weight of the composition, (ii) at least one amine oxide surfactant selected from lauryl amidopropyl dimethyl amine oxide and myristyl amidopropyl dimethyl amine oxide or a mixture thereof, wherein the at least one amine oxide surfactant is present in an amount of from 3 to 8 weight % based on the weight of the composition, (iii) at least one polyethylene oxide-polypropylene oxide block copolymer which is present in an amount of from 1 to 2 weight % based on the weight of the composition, wherein the polyethylene oxide-polypropylene oxide block copolymer has the formula $(EO)_x(PO)_y(EO)_z$ where EO is ethylene oxide, PO is propylene oxide, x=11+/−3, y=21+/−5 and z=11+/−3, (iv) ethanol which is present in an amount of from 1 to 2 weight % based on the weight of the composition, and (v) water.

* * * * *